United States Patent [19]

Finch

[11] 4,079,653

[45] Mar. 21, 1978

[54] METHOD AND APPARATUS FOR IMITATING SPEECH CHARACTERISTICS OF VOX HUMANA AND SIMILAR REED ORGAN PIPES

[75] Inventor: Robert A. Finch, Palos Park, Ill.

[73] Assignee: Richard H. Peterson, Palos Park, Ill.

[21] Appl. No.: 739,906

[22] Filed: Nov. 8, 1976

[51] Int. Cl.[2] ..... G10H 1/06; G10H 5/10

[52] U.S. Cl. ..... 84/1.22; 84/1.01; 84/1.11; 179/1 SG

[58] Field of Search ..... 84/1.01, 1.11, 1.19, 84/1.2, 1.22, DIG. 8, DIG. 9; 179/1 SG, 1 SM, 1 M

[56] References Cited

U.S. PATENT DOCUMENTS

| | | | |
|---|---|---|---|
| 1,823,724 | 9/1931 | Carlson | 84/1.01 |
| 2,760,132 | 8/1956 | Pawley | 84/1.20 |
| 3,000,252 | 9/1961 | Wayne, Jr. | 84/1.01 |
| 3,723,633 | 3/1973 | Adachi | 84/1.01 |
| 4,023,455 | 5/1977 | Peterson | 84/1.21 |
| 4,043,243 | 8/1977 | Peterson | 84/1.24 |

*Primary Examiner*—Edith S. Jackmon
*Attorney, Agent, or Firm*—Spencer E. Olson

[57] ABSTRACT

In an electronic musical instrument, such as an electronic organ, the speech characteristics of Vox Humana and similar reed organ pipes are simulated by applying a repeating series of pulse groups separated from each other, which groups each contain a short sequence of two or more pulses, to a sharp cutoff low-pass filter for converting the series of pulse groups into a sound producing signal simulative of the sound signal produced by a Vox Humana or similar organ pipe. The repeating series of pulse groups is obtained by nonlinearly combining square wave tone signals from two or more different octaves of a conventional phase-locked tone generator. The synthesized repeating series of pulse groups, one series for each note of the instrument, are applied to a single low-pass filter, or grouped and applied to a small number of filters.

7 Claims, 9 Drawing Figures

METHOD AND APPARATUS FOR IMITATING SPEECH CHARACTERISTICS OF VOX HUMANA AND SIMILAR REED ORGAN PIPES

FIELD OF THE INVENTION

This invention relates to electrical musical instruments, and more particularly to electronic circuit means for producing tonal effects highly imitative of the speech characteristics of certain organ reed voices such as Vox Humana, Kinura, Musette and Krummet.

BACKGROUND OF THE INVENTION

Over the centuries wind operated pipes have been developed to produce a wide variety of musical sounds, the pipe organ being a common application thereof. Pipe organs usually include a separate set or rank of pipes for each stop of the organ; thus, there might be one rank of 61 Diapason pipes (including one pipe for each note), and another rank of 61 Flute pipes, and another of 61 Trompette pipes, etc. Any particular rank can further be characterized as being made up of "flue" pipes or "reed" pipes. While there are almost countless varieties within each family, flue pipes are all essentially whistles, with the differences in tone color between one flue rank and another being determined by the relative dimensions of corresponding pipes, the material of which they are constructed, whether the pipes are open or stopped, and other factors.

Reed pipes generate tones in an entirely different manner, the primary source of tone being a vibrating brass reed which is coupled with a resonator for determining the characteristics of the tone. Over the long period of development of pipe organs, organ reed pipes have been successfully designed to be highly imitative of certain orchestral voices. However, because the natural speech characteristics of a reed, due to its mechanical construction and the nature of its operation, are not the same as the speech characteristics of the orchestral instruments they are intended to simulate, it has not been possible to make reeds sound exactly like orchestral voices. Organ reeds nonetheless have a certain quality and charm that cannot be duplicated by orchestral instruments, and it is the object of the present invention to provide an electronic organ that simulates the unique characteristics of that class of reed organ pipes that includes Kinura, Musette, Krummet and Vox Humana.

A reed organ pipe consists essentially of a reed tube having an opening, called a shallot, cut into one side thereof, against which a brass reed tongue is held by a tuning wire having spring tension, the reed and shallot being enclosed in a boot having an opening at the bottom, which communicates with a windchest to allow air into the pipe when its corresponding valve is operated, and a resonator coupled to the boot. Depending upon the desired organ voice, the resonator takes a variety of forms, such as a tapered, open-ended resonator for a chorus reed stop such as an organ Trompette, a partially closed flared pipe for obtaining an Oboe tone, a slightly tapered pipe with a slot in its wall near its remote end for a more imitative Orchestral Oboe, or capped resonators of various shapes and sizes to achieve other tonal effects. The resonators are usually scaled so as to be approximately one-half the wavelength of the sound of the note to be produced, but many interesting tone qualities are produced by pipes having short length resonators, as for example, the Kinura and Vox Humana.

In operation, the brass reed or tongue vibrates against the shallot, the reed being supported with respect to the shallot so that it essentially "rolls" past the shallot upon opening and closing so as to gradually open and close the opening; the size and shape of the reed and its curvature relative to the size and shape of the shallot determine the shape of the pulse of air that excites the resonator, which, in turn, determines the tonal quality. The relationship between the reed and the resonator also affect the tonal quality: if the resonator is tuned sharp or flat relative to the tuning reed, the resulting sound is either "choked" or "free", respectively. By appropriately adjusting the shape, configuration and size of the resonator used with a particular reed one can adjust the tone quality of a given pipe over a wide range, making it possible to make organ reed pipes highly imitative of certain orchestral voices. It is again emphasized, however, that the object of the present invention is not to simulate orchestral voices but, rather, to simulate by electronic circuit means the peculiar characteristics of certain reed pipes, thereby to imitate natural pipe organ voices.

The co-pending patent application Ser. No. 641,716 of Richard H. Peterson filed Dec. 17, 1975 which is now U.S. Pat. No. 4,023,455 and is commonly assigned, describes a system in which the speech characteristics of reed pipes are simulated by applying a train of electrical pulses rich in natural harmonics to a sharp cutoff low-pass filter having a sharp knee and a very rapid rate of roll-off, of the order of 24dB per octave or greater, above the cutoff frequency, the object being that as the frequency of the harmonics of the pulse signal increases, the amplitude of the output signal from the filter remains essentially constant up to the cutoff frequency and thereafter essentially immediately drops for frequencies above the cutoff frequency. Using a filter having these characteristics, the resultant output signal produces a sound which is surprisingly reed-like. To simulate the change in pitch that occurs in a reed pipe when the reed is partially open and as it is closing, particularly when it is just opening, the cutoff frequency of the filter is made automatically adjustable, from its lowest cutoff frequency when no keys of the organ are played to a higher cutoff frequency when a key is played, such higher cutoff frequency permitting several more harmonics to pass through the filter, the number being appropriate to produce the characteristic of a particular reed voice.

While the described Peterson system produces tonal effects highly imitative of the speech characteristics of many reed organ pipes, it is unable, because of their significantly different tonal characteristics, to provide the desired imitation of reed organ voices such as Kinura, Musette, Krummet and Vox Humana, the Vox Humana being the one most typically used. These voices, unlike those produced by most other reed organ pipes, have in addition to a cutoff characteristic a resonant characteristic which together produce the vowel-like sounds typical of this class of reed organ pipes. The reed vibrates at a fundamental frequency and the associated resonator, a high Q acoustic resonant circuit, is designed to strongly emphasize the fundamental and one of the higher order harmonics, and to greatly attenuate the harmonics falling in between. A similar vowel sound can be produced by processing a single pulse through a high Q resonant circuit, but this approach is prohibitively expensive because a separate resonant circuit, each with a different characteristic, is required for each note or small group of notes, to obtain the proper formant for each note of the musical scale.

The primary object of the present invention is to provide, at moderate cost, electronic circuit means for producing tonal effects highly simulative of Vox Humana and similar reed organ pipes.

SUMMARY OF THE INVENTION In accordance with the present invention, the speech characteristics of Vox Humana and similar reed pipes are simulated by applying a repeating series of pulse groups separated from each other by the period of a predetermined fundamental frequency, which groups each contain a short sequence of two or more closely spaced pulses, to a sharp cutoff low-pass filter which effectively converts the series of pulses to a series of sine waves thereby to simulate what happens when a single pulse is applied to a properly designed resonant circuit, which, in turn, is the analog of what happens in a Vox Humana pipe. The repeating series of pulse groups is synthesized by non-linearly combining square wave signals representative of selected octaves generated by a conventional phase-locked tone generator. For example, in an electronic organ having five octaves in which a given note in the first octave has a frequency $f$, a frequency $2f$ in the second octave, and so on, square wave output signals corresponding to a given note from octaves one, three and four are combined to produce a repeating series of groups of two closely-spaced pulses separated by the period of the fundamental frequency $f$; when this pulse train is applied to a high Q, sharp cutoff low-pass filter the result is a close electrical analog of the reed-resonator combination of a Vox Humana organ pipe. The synthesized repeating series of pulse groups, one series for each note of the instrument, are applied to a single low-pass filter, or grouped and applied to a small number of filters, thereby to significantly reduce the complexity and cost of the system as compared to previous systems utilizing one filter for each note.

BRIEF DESCRIPTION OF THE DRAWING

Other objects and advantages of the invention will become apparent, and its construction and operation better understood, from the following description, taken in conjunction with the accompanying drawings, in which.

DESCRIPTION OF THE PREFERRED EMBODIMENT

Figure 1:
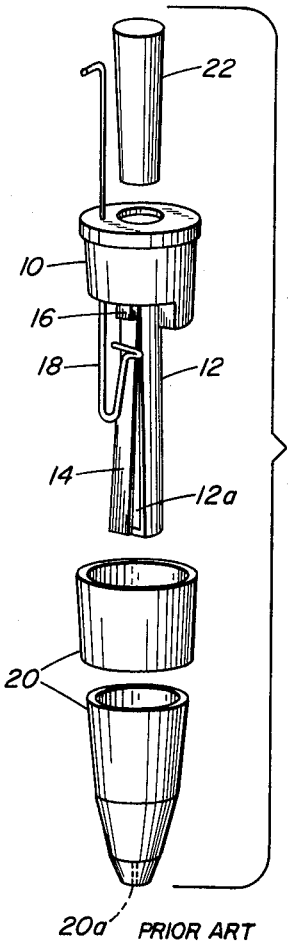
FIG. 1 is an exploded perspective view of a typical reed organ pipe according to the prior art.
Figures 1A, 1B:
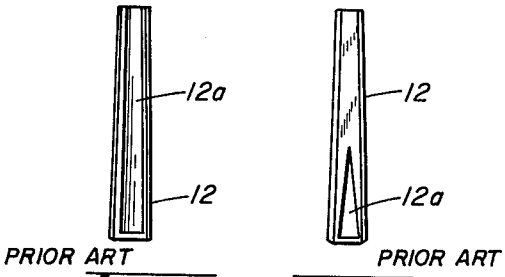
FIGS. 1A and 1B are plan views of two forms of shallot utilized in reed organ pipes according to the prior art.

It being an object of the present invention to electronically simulate the speech characteristics of Vox Humana and similar reed organ pipes, it will be useful for an appreciation of the requirements of the electronic analog to understand how sounds of various tonal qualities are produced in an organ reed pipe. FIG. 1 is an exploded perspective view of a typical reed organ pipe, which consists of a cylindrical block 10 into the lower end of which is affixed a reed tube 12 having an opening 12*a*, called a shallot, cut into one side. A brass reed tongue 14 is secured at its upper end against the reed tube by a wedge 16 and is held against the shallot by a tuning wire 18 having spring tension. The reed is tuned by moving the tuning wire up and down along the tongue to adjust the length of the free end of the tongue. The reed pipe is enclosed by a boot 20 have an opening 20*a* at the bottom thereof; the boot is inserted in the windchest of the organ (not shown) from which air at substantially uniform pressure enters the pipe when its corresponding valve is operated. A resonator 22 inserted in the upper end of the block 10 completes the reed organ pipe. The opening in the shallot takes a variety of forms and sizes depending upon the voice it is intended that the reed organ pipe produce. FIG. 1A illustrating the front of an "open" shallot in which the opening is generally rectangular and extends substantially the full length of the reed pipe 12, and FIG. 1B showing the front of one form of "closed" shallot in which the opening 12*a* starts above the base and forms a pocket at the bottom of the shallot 12.

In operation, as air at substantially constant pressure enters the opening at the bottom of the boot, the brass reed 14 vibrates against the shallot 12*a*, the reed having a curvature such that it essentially "rolls" past the opening as it opens and closes. The shape of the pulses or air produced by the opening and closing of this "valve" and which excite the resonator 22, is determined by the size and shape of the brass tongue 14, its curvature, and the size and shape of the opening in the shallot; the shape of the pulse as the "valve" opens and closes with respect to time determines the tone quality of the reed. The tone quality is also affected by the relationship between the reed and the resonator 22; known resonators are of a wide variety of shapes and/or sizes, and by tuning the resonator sharp or flat relative to the tuning of the reed, a sound which is either choked or free is produced.

Figures 2A, 2B:
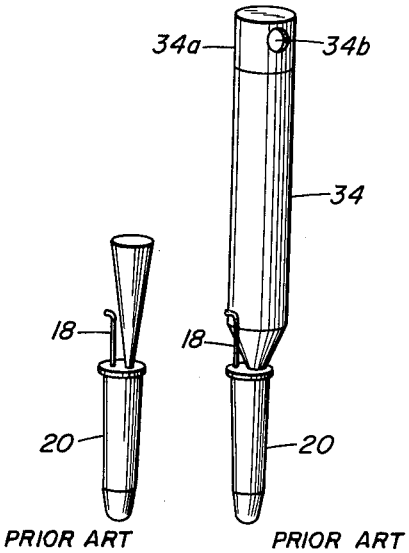
FIGS. 2A and 2B are perspective views of typical reed organ pipes illustrating the general shape of Kinura and Vox Humana resonators, respectively according to the prior art.

FIGS. 2A and 2B, respectively, illustrate the general shape of a Kinura resonator 32 and a Vox Humana resonator 34. The latter has a rotatable cap 34*a* for varying the size of a hole 34*b* in the wall of the resonator for controlling the character of the produced tone. While the resonators of most reed organ pipes are scaled so as to approximately one-half of the wavelength of the sound of the note to be produced, the interesting tone qualities of Kinura and Vox Humana pipes are achieved by using the illustrated shortlength resonators.

The vowel-like sounds produced by this class of reed organ pipes have in addition to a cutoff characteristic a resonant characteristic determined by the short resonator. The reed of the pipe vibrates at a fundamental frequency and the associated resonator, a high Q acoustic resonant circuit, is dimensioned to strongly emphasize the fundamental and one of the higher order harmonics, and to greatly attenuate the harmonics falling in between.

The present invention is based on the above-outlined understanding of the mechanics of the Vox Humana and similar reed organ pipes and the recognition that sound signals have properties closely analogous to those generated by an acoustical reed pipe can be relatively simply and inexpensively generated. More specifically, the invention contemplates the generation from signals available from the tone generator of an organ, which in themselves do not afford the desired simulation of the organ reed pipe sound, a waveform having characteristics such that when it is suitably filtered produces a waveform that looks and sounds remarkably similar to the sound waveform of a Vox Humana or similar reed pipe. The desired waveform is obtained by non-linearly combining square wave signals representative of the same note from two or more selected octaves generated by a phase-locked tone generator so as to produce a repeating series of pulse groups separated from each other by the period of the fundamental frequency of the lowest octave involved in the combining process. When this pulse train waveform is filtered to round off the edges of the sharp pulses, the resulting waveform is a close analogy of the sound signal produced by a Vox Humana pipe in that the fundamental and certain higher order harmonics are emphasized and harmonics in between are virtually absent. The system does not utilize resonators to obtain the desired sound signal, and doesn't require modification of the waveform by a formant, yet because of the manner in which the sound signal is generated a resonator of a certain size is simulated for each note, getting proportionately larger as one goes up the scale, thereby effectively providing a formant that moves with the note as it does in the pipes of an actual organ.

Figure 3:
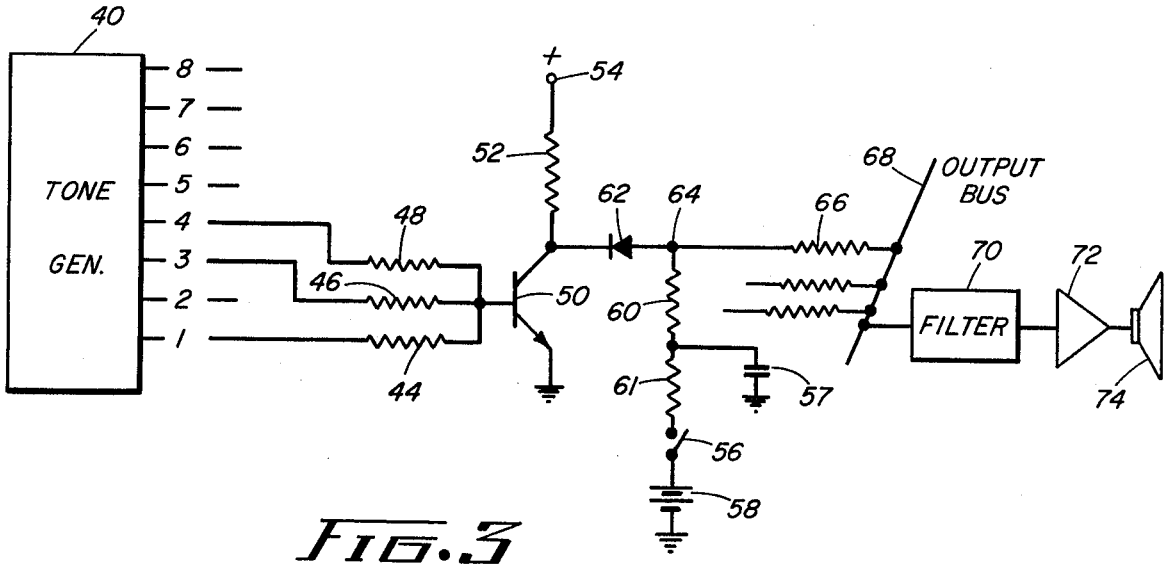
FIG. 3 is a schematic diagram of a sound signal generating system embodying the invention.
Figure 4:
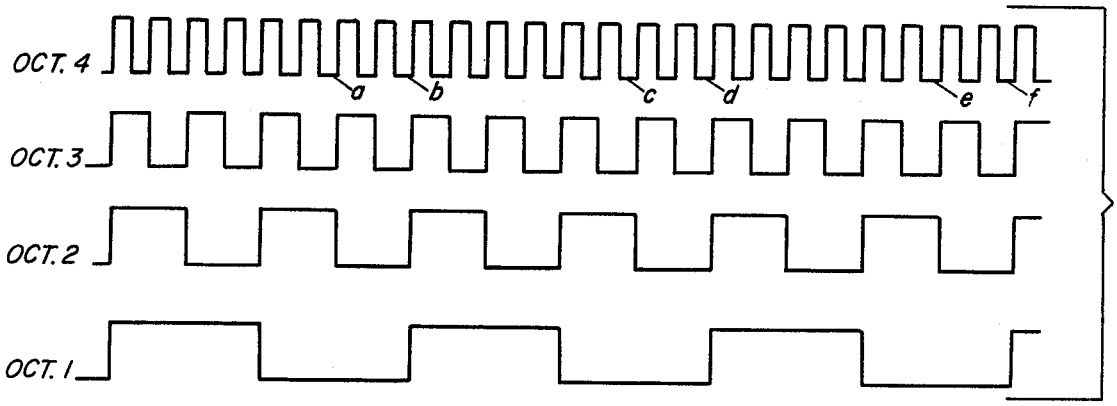
FIG. 4 is a series of waveforms useful in explaining the principle of the invention.

A system for achieving the above-outlined objectives is shown in FIG. 3, the illustrated circuit being for a single note of a musical instrument. Signals of square waveform are obtained from a tone generator 40, which may be of conventional design, and produces a plurality of output tones, one for each note in a plurality of octaves. As illustrated in FIG. 3, the tone generator generates eight octaves, indicated by the output lines numbered 1 through 8, with the same note appearing on each of the output lines. That is, output line 1 may have an output signal of frequency corresponding to note $C_1$, output line 2 a note corresponding to $C_2$, and so on. Thus, as illustrated by the waveforms of FIG. 4, the square wave signal appearing on output line 1 has a frequency $f$ depicted by the waveform labeled "OCT.1", the signal on output line 2 has a frequency $2f$ as depicted by the waveform labelled "OCT. 2", the output on line 3 has a frequency of $4f$ and the signal on output line 4 has a frequency $8f$.

Figure 5:
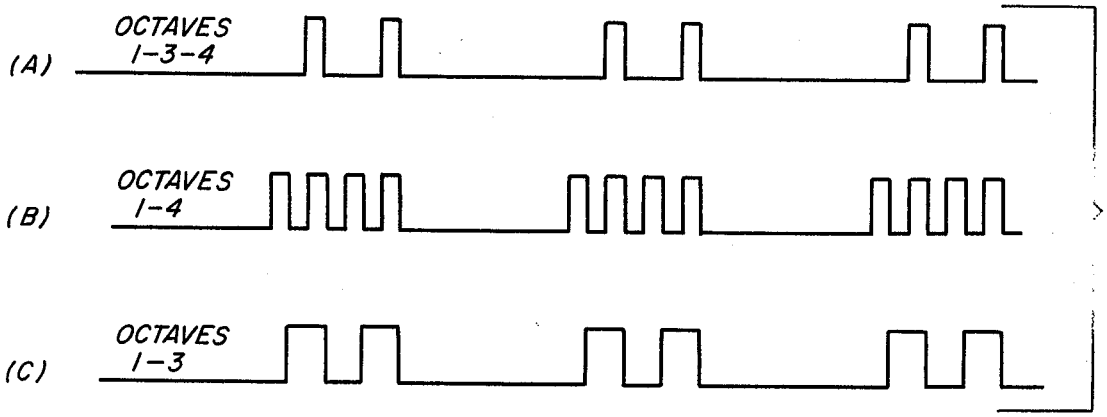
FIG. 5 is a series of waveforms produced by selected combinations of the waveforms of FIG. 4.

In the illustrated embodiment of the invention, the output signals from three octaves are added nonlinearly in a multiple input NOR gate which functions to produce a positive output only when all of the inputs are "low". In particular, and for reasons which will shortly become apparent, the output tones from octaves 1, 3 and 4 are coupled via respective resistors 44, 46 and 48 to the base electrode of a transistor 50 the emitter electrode of which is grounded and the collector electrode of which is connected through a resistor 52 to a source of positive potential represented by terminal 54. Examination of the waveforms of FIG. 4 will indicate that the input signals to the base of transistor 50 are "low" at the same time only during the occurrence of negative-going pulses *a, b, c, d, e,* and *f* in the tone signal from octave 4. Thus, there is produced at the collector electrode of transistor 50 a signal having the waveform illustrated in FIG. 5(A), consisting of a repeating series of pulse groups, each group containing two pulses, separated from each other by the period of the fundamental frequency $f$ of the tone signal from octave 1.

A gating circuit for the single note sound signal represented by waveform FIG. 5A includes a key switch 56 of the associated key of the organ keyboard, a keying supply voltage represented by the battery 58, a resistor 60, and an envelope circuit consisting of a resistor 61 connected in series with resistor 60 and a capacitor 57 connected between the junction of resistors 60 and 61 and ground for determining the on or off characteristics of the gate. When the key switch 56 corresponding to the note applied to the inputs of the NOR gate is closed, the keying voltage is applied through resistor 60 to forward-bias a diode 62, whose cathode is connected to the collector electrode of the transistor, whereby the keying voltage is effectively chopped to produce at junction point 64 a signal having the waveform shown in FIG. 5A. This signal is coupled via a resistor 66 to an output bus 68, on which the outputs of a group of similar gates (one for each note) would be collected.

Figure 6:
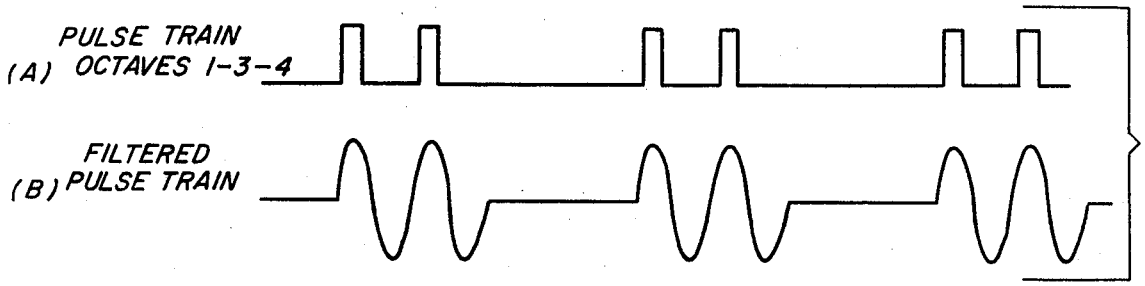
FIG. 6 shows a pair of waveforms illustrating how the sound producing signal is formed.

The signals collected on the output bus 68 are applied to the input of a filter 70 having a pass characteristic such as to modify the rectangular pulses contained in the FIG. 5A signal (repeated as FIG. 6A) and to produce essentially the waveform shown in FIG. 6B, consisting of two cycles of a sinusoidal waveform signal for each group of pulses in the pulse train, separated by the period of one cycle of the fundamental frequency $f$. This result is obtained by using a low-pass, sharp cutoff filter, the cutoff frequency of which is sufficiently high to pass the highest note on the keyboard that is involved in the generation of the Vox Humana sound signal. In a system that has been satisfactorily operated, wherein octaves 1, 3 and 4 were combined to generate the sound producing signal, the filter had a cutoff frequency of approximately 2KHz and a rate of rolloff of 24db per octave. It is to be understood, however, that there may be some departure from those specifications, and that they may be different if voices other than Vox Humana are to be simulated, the important consideration being that the cutoff frequency be sufficiently low to eliminate most of the very high order harmonics present by reason of the fast rise edges of the pulses within the pulse groups so that the fundamental and the harmonic frequency of the bursts of sinusoidal waveform signals are the principal determinants of the voice characteristics of the reproduced sound signal. It is also important that the filter be AC-coupled so that the resulting signal is symmetrical as shown in FIG. 6B, so as to simulate the ringing signal that would be produced when a single pulse is applied to a resonator. The output signal from the filter is amplified in a suitable power amplifier 72 and applied to a loudspeaker 74 for reproduction.

In an organ system embodying the just-described sound signal generating system, a single tone generator, common to the entire system, can be used, and, as has been noted earlier, there must be one gate of the kind shown in FIG. 3 for each key switch, or 61 in electronic organs of conventional size. While it is possible to couple the outputs of all of the gates to a single filter 70 and a single reproducing system, it is generally preferable to group the notes into a plurality of channels, for example, four, and provide a filter and speaker system for each of the channels.

Although in the system of FIG. 3 the outputs of octaves 1, 3 and 4 are combined to produce the sound signal, other combinations of octaves can be non-linearly added to produce repeating series of pulse groups separated from each other by the period of a fundamental frequency, which when subjected to suitable filtering will also produce a sound signal simulative of Vox Humana and similar reed organ pipes. For example, if corresponding tone signals from octaves 1 and 4 are combined, a signal having the waveform illustrated in FIG. 5B results, consisting of separated groups of four pulses of the same frequency as the octave 4 tone. Similarly, when the tone signals from octaves 1 and 3 are non-linearly added in the manner described in connection with FIG. 3, there is produced a signal having the waveform depicted in FIG. 5C, consisting of separated groups of two pulses the period of which corresponds to the period of the octave 3 tone. Although only three possible combinations of multiple octaves have been illustrated, it is to be understood that other combinations, including tones from octaves higher than the fourth, can be made to produce other repeating series of separated pulse groups in which the makeup of the groups differs from the three possibilities shown in FIG. 5 but which, nonetheless, upon suitable filtering, produce a sound signal highly simulative of Vox Humana or similar reed organ pipe sounds.

I claim:

1. In an electronic organ including a tone generator for producing a plurality of octaves of tone signals, one for each note of a musical scale, each consisting of square wave pulses phase-locked to the others, apparatus for generating sound signals which upon reproduction imitate the speech characteristics of Vox Humana and similar reed organ pipes, said apparatus comprising:

means for non-linearly combining tone signals representing corresponding notes from two or more different octaves for producing a repeating series of pulse groups separated from each other by the period of the lowest frequency tone signal included in the combination, which groups each contain a short sequence of two or more pulses, at least one low-pass filter circuit means, said filter circuit means having a sharp cutoff and a rapid rate of roll-off above its cutoff frequency, and player-controlled gate circuit means, one for each note, for selecting desired ones of said repeating series of pulse groups and coupling the same to said filter circuit means.

2. Apparatus according to claim 1, wherein said combining means is operative to combine three tone signals of frequencies $f$, $4f$ and $8f$ to produce a repeating series of pulse groups each containing a short sequence of two pulses.

3. Apparatus according to claim 1, wherein said combining means is operative to combine two tone signals of frequencies $f$ and $8f$ to produce a repeating series of pulse groups each containing a short series of four pulses.

4. Apparatus according to claim 1, wherein said combining means is operative to combine two tone signals of frequencies $f$ and $4f$ to produce a repeating series of pulse groups each containing a short series of two pulses.

5. Apparatus according to claim 1, wherein said filter circuit means has a cutoff frequency of about 2KHz.

6. Apparatus according to claim 5, wherein said filter circuit means has a roll-off rate of substantially 24db per octave.

7. A method for generating sound signals which when reproduced imitate the speech characteristics of Vox Humana and similar reed organ pipes, comprising the steps of:

generating a plurality of octaves of tone signals, one for each note of a musical scale, each consisting of square wave pulses phase-locked to the others, non-linearly combining tone signals representing corresponding notes from two or more different octaves for producing a repeating series of pulse groups separated by the period of the lowest frequency tone signal included in the combination, which groups each contain a short sequence of two or more pulses, and filtering said repeating series of pulse groups in a sharp cutoff low-pass filter.

* * * * *